US006224260B1

(12) United States Patent
Nickell et al.

(10) Patent No.: US 6,224,260 B1
(45) Date of Patent: May 1, 2001

(54) CONSOLIDATION CONTAINER

(75) Inventors: Craig Alan Nickell, Sherman; Bobby Glenn Brown, Dennison; Bradley Matthew Eisenbarth, Sherman, all of TX (US)

(73) Assignee: B.A.G. Corporation, Dallas, TX (US)

( * ) Notice: Subject to any disclaimer, the term of this patent is extended or adjusted under 35 U.S.C. 154(b) by 0 days.

(21) Appl. No.: 09/547,442

(22) Filed: Apr. 12, 2000

Related U.S. Application Data

(63) Continuation-in-part of application No. 09/458,362, filed on Dec. 9, 1999.

(51) Int. Cl.[7] ..... B65D 33/02
(52) U.S. Cl. ..... 383/119
(58) Field of Search ..... 383/107, 109, 383/117, 119, 105, 32, 120, 66, 81, 86, 7

(56) References Cited

U.S. PATENT DOCUMENTS

| | | | | |
|---|---|---|---|---|
| 2,423,889 | * | 7/1947 | Hurt | 383/81 |
| 4,090,542 | * | 5/1978 | Hacker, Jr. | 383/120 X |
| 4,903,859 | * | 2/1990 | Derby et al. | 383/119 X |
| 5,025,925 | * | 6/1991 | Wiklund | 383/119 X |
| 5,286,112 | * | 2/1994 | Bible | 383/86 |
| 5,289,937 | * | 3/1994 | Boots | 383/119 X |
| 5,897,211 | | 4/1999 | Hafer, et al. . | |
| 6,000,549 | | 12/1999 | Perkins . | |
| 6,004,035 | | 12/1999 | Hafer, et al. . | |
| 6,015,057 | | 1/2000 | Stone et al. . | |

FOREIGN PATENT DOCUMENTS

| | | | | |
|---|---|---|---|---|
| 552845 | * | 7/1993 | (EP) | 220/9.1 |
| 1201167 | * | 12/1989 | (FR) | 383/119 |
| 2639037 | * | 5/1990 | (FR) | 220/9.1 |
| WO097/20758 | * | 6/1997 | (WO) . | |
| PCT/IE99/00115 | | 11/1999 | (WO) . | |

* cited by examiner

*Primary Examiner*—Allan N. Shoap
*Assistant Examiner*—Robin A. Hylton
(74) *Attorney, Agent, or Firm*—Michael A. O'Neil

(57) ABSTRACT

A consolidation container includes a back wall, side walls, and a front wall each comprising pockets which receive stiffening panels. The front wall has an openable center portion which provides access to the interior of the container. Support members are positioned in the corners of the container to facilitate stacking. A top normally overlies the wall to close the container and is fully openable to provide access to the interior thereof.

9 Claims, 9 Drawing Sheets

CONSOLIDATION CONTAINER

CROSS REFERENCE TO RELATED APPLICATIONS

This is a continuation-in-part application under 37 C.F.R. §1.53 of application Ser. No. 09/458,362 filed Dec. 9, 1999, currently pending.

TECHNICAL FIELD

The present invention relates generally to flexible intermediate bulk containers, also known as bulk bags, and more particularly to consolidation containers which are adapted for stacking one on top of another.

BACKGROUND AND SUMMARY OF THE INVENTION

Over the past thirty years flexible intermediate bulk containers, commonly known as bulk bags, have come into widespread use for receiving, storing, transporting, and discharging flowable materials of all types. Although circular bulk bags are known, bulk bags are typically constructed from rectangular panels which are sewn together along their adjacent edges to define a bulk bag which is initially square or rectangular in horizontal cross section. Nevertheless, all bulk bags, whether initially square, rectangular, or circular in cross section tend to assume a circular configuration when filled due to the uniform pressure imposed by the contents of the bulk bag against the flexible fabric side walls thereof.

U.S. Pat. No. 4,903,859 discloses a bulk bag comprising four double layer side walls. Stiffeners formed from cardboard are inserted between the layers of the side walls thereby imparting sufficient rigidity to the container for permitting its use with liquids. Although the bulk bag of the '859 patent has been generally well received, its utilization has been somewhat limited by the fact that it cannot be stacked.

Co-pending application Ser. No. 09/390,403 assigned to the assignee hereof (doing business as Composite Container Corp.) discloses an improvement over the bulk bag of the '859 patent. In application Ser. No. 09/390,403 there is disclosed a bulk bag having double layer side walls and vertically extending corner pockets. Plywood sheets are received between the layers of the side walls and wooden posts are received in the corner pockets to provide a bulk bag suitable for use with liquids which is stackable.

U.S. Pat. No. 5,076,710 discloses a baffle-type bulk bag wherein bridge panels or baffles are sewn across the four corners of a nominally rectangular bulk bag. The baffles prevent the side walls of the bulk bags from bulging outwardly when the bulk bag is filled, thereby retaining the filled bulk bag in a more or less rectangular cross-sectional configuration. The baffles may be provided with apertures which allow material to flow into and out of the corners of the bulk bag during filling and discharging operations.

Co-pending application Ser. No. 09/458,362 also assigned to the assignee hereof discloses a baffle-type bulk bag which is stackable. In the bulk bag of application Ser. No. 09/458,362, triangular stiffeners are provided in the triangular corners of baffle-type bulk bags. The stiffeners may be formed from various materials including plastic panels, panels formed from corrugated paperboard and similar materials, etc. The stiffeners may be provided with apertures aligned with the apertures of the baffles thereby permitting the flow of material into and out of the bulk bag during filling and discharging operations.

The present invention comprises an improvement over the bulk bags disclosed in the '859 and '710 patents and in the '403 and '362 patent applications which provides a consolidation container that is stackable. In accordance with the broader aspects of the invention, there is provided a consolidated container comprising double layer side walls. Each double layer side wall receives a stiffening panel which extends substantially the entire length and width of the side wall. Each corner of the consolidation container comprises a vertically disposed pocket which receives a support member.

The stiffening panels used in the side walls of the consolidation container of the present invention may comprise corrugated plastic panels or similar panels made from other materials which are sufficiently resistant to bending. The support members are preferably formed from wood although other materials can also be used.

Consolidation containers incorporating the present invention are adapted for mounting on pallets. The containers may also be provided with lift loops. The containers have openable tops and foldable front wall portions which provide access to the contents of the containers.

BRIEF DESCRIPTION OF THE DRAWINGS

A more complete understanding of the invention may be had by reference to the following Detailed Description when taken in conjunction with the accompanying Drawings, wherein.

DETAILED DESCRIPTION

Figure 1:
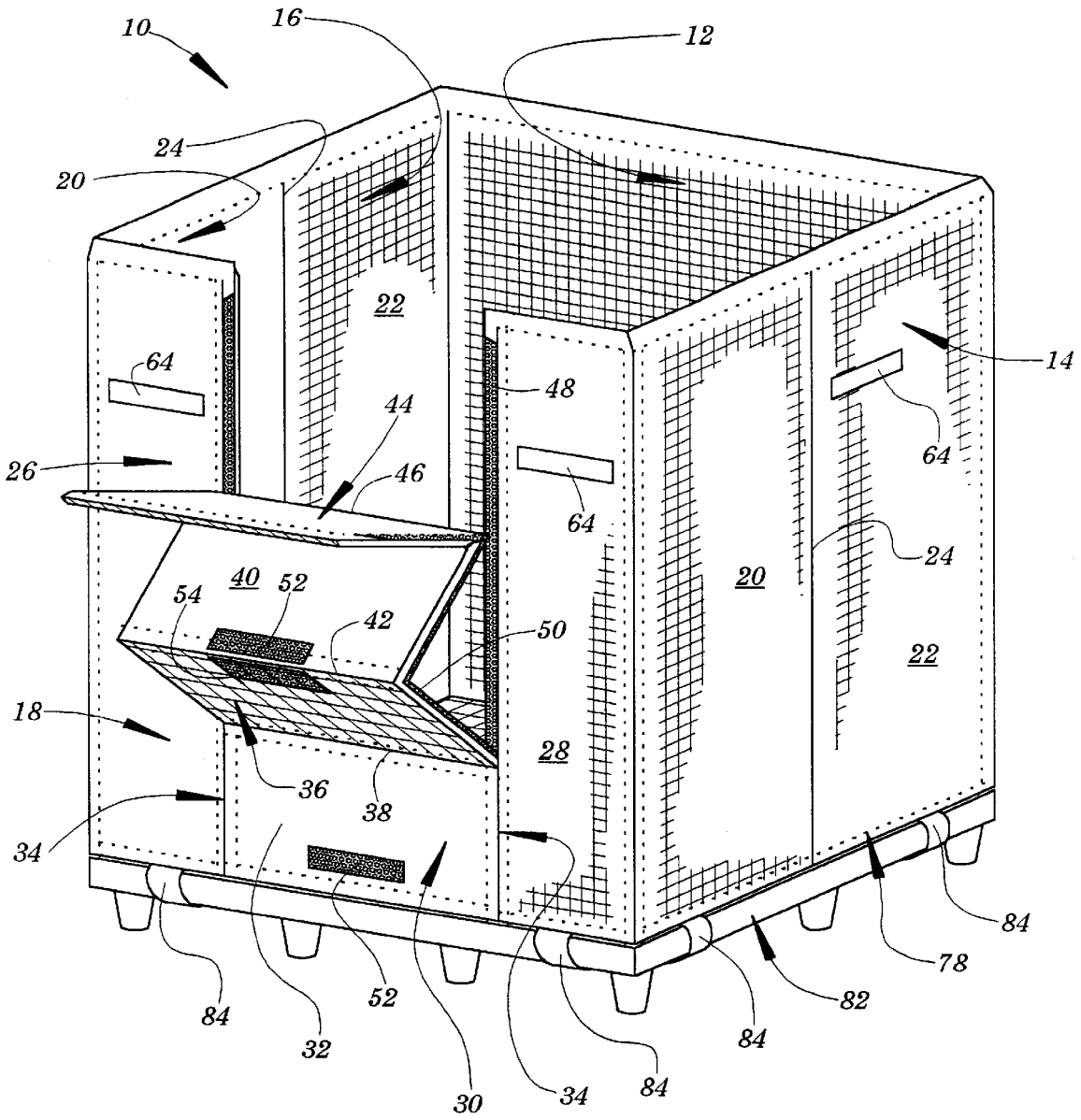
FIG. 1 is a partial perspective view illustrating the consolidation container of the present invention with the top removed and the front panel partially opened.

Referring now to the Drawings, and particularly to FIGS. 1–4 thereof, there is shown a consolidation container 10 comprising the preferred embodiment of the invention. The consolidation container 10 comprises a back wall 12, opposed side walls 14 and 16, and a front wall 18.

The side walls 14 and 16 each comprise a front portion 20 and a back portion 22 which are separated by a vertically disposed seam 24. The front wall 18 comprises side portions 26 and 28 and an openable center portion 30.

Figure 3:
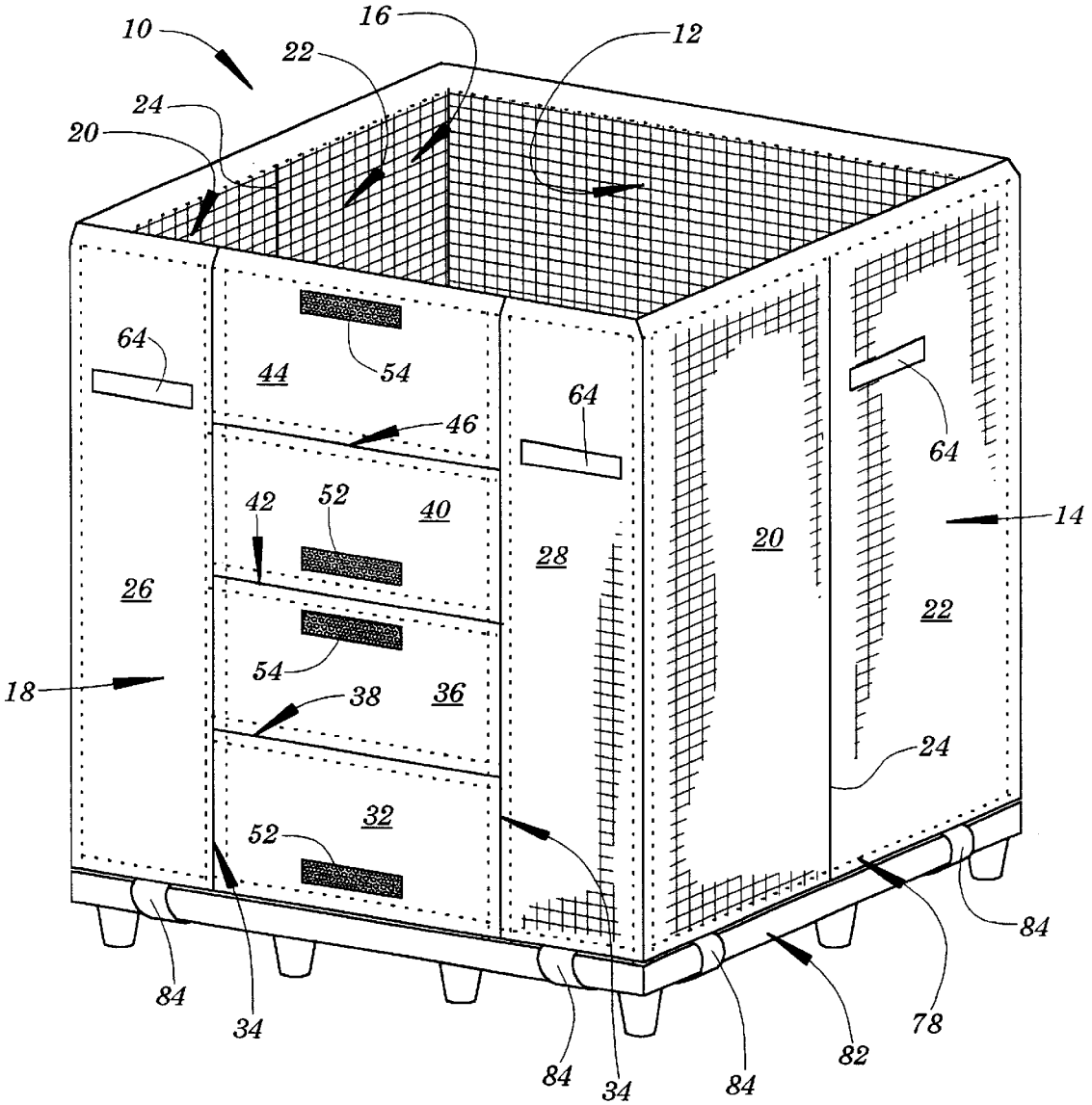
FIG. 3 is a view similar to FIG. 1 showing the front panel of the consolidation container fully closed.

Referring particularly to FIG. 3, the center portion 30 of the front wall 18 comprises a fixed section 32 which is secured to the side portions 26 and 28 by seams 34. The center portion 30 of the front wall 18 further comprises three hingedly secured sections including a lower section 36 which is hingedly secured to the fixed section 32 by a fabric hinge 38, a center section 40 which is hingedly secured to the lower section 36 by a fabric hinge 42, and an upper section 44 which is hingedly secured to the center section 40 by a fabric hinge 46.

Figure 2:
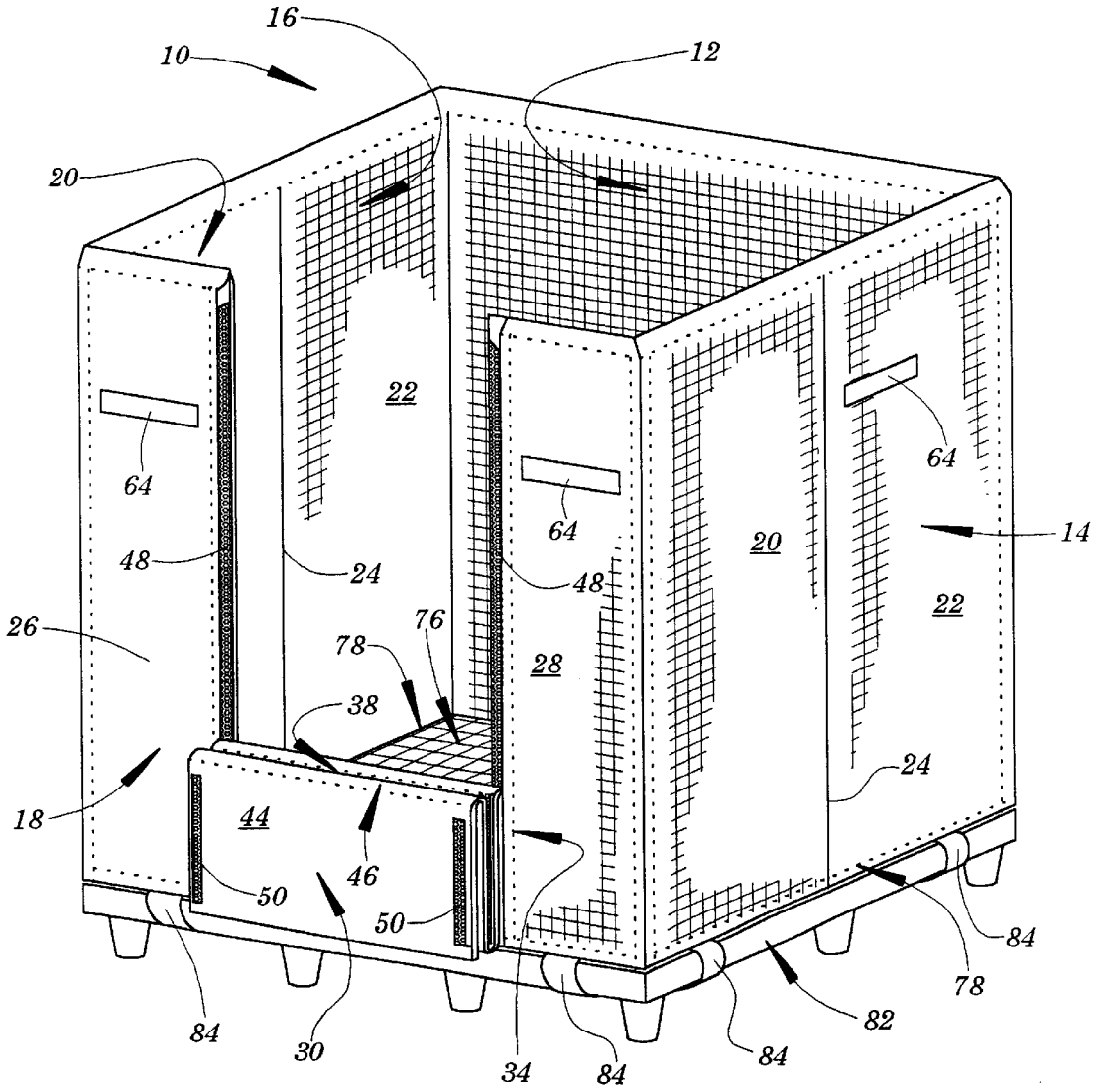
FIG. 2 is a view similar to FIG. 1 showing the front panel of the consolidation container fully opened.

As is clearly shown in FIGS. 1, 2, and 3, the lower section 36, the center section 40 and the upper section 44 of the center portion 30 of the front wall 18 are pivotable between the fully closed position of FIG. 3 through the partially opened position of FIG. 1 to the fully opened positioned of FIG. 2. The openable center portion 30 of the front wall 18 is preferably provided with hook-and-loop fasteners of the type sold under the trademark VELCRO® which are employed to secure the lower section 36, the center section 40, and the upper section 44 either in the fully closed position of FIG. 3 or in the fully open position of FIG. 2. Other types and kinds of fasteners, such as zippers and snaps, can also be used in the practice of the invention.

Specifically, cooperating hook-and-loop fastener strips 48 and 50 or zippers may be provided on the inner edges of the side wall portions 26 and 28 and on the outer edges of the sections 36, 38, and 44 to secure the center portion 30 of the front wall 18 in the closed position of FIG. 3. Cooperating hook-and-loop fastener portions 52 and 54 or snaps likewise may be provided on the outwardly facing surfaces of the sections 32, 36, 40, and 44 of the center portion 30 to secure the center portion 30 in the fully open configuration of FIG. 2.

Figure 4:
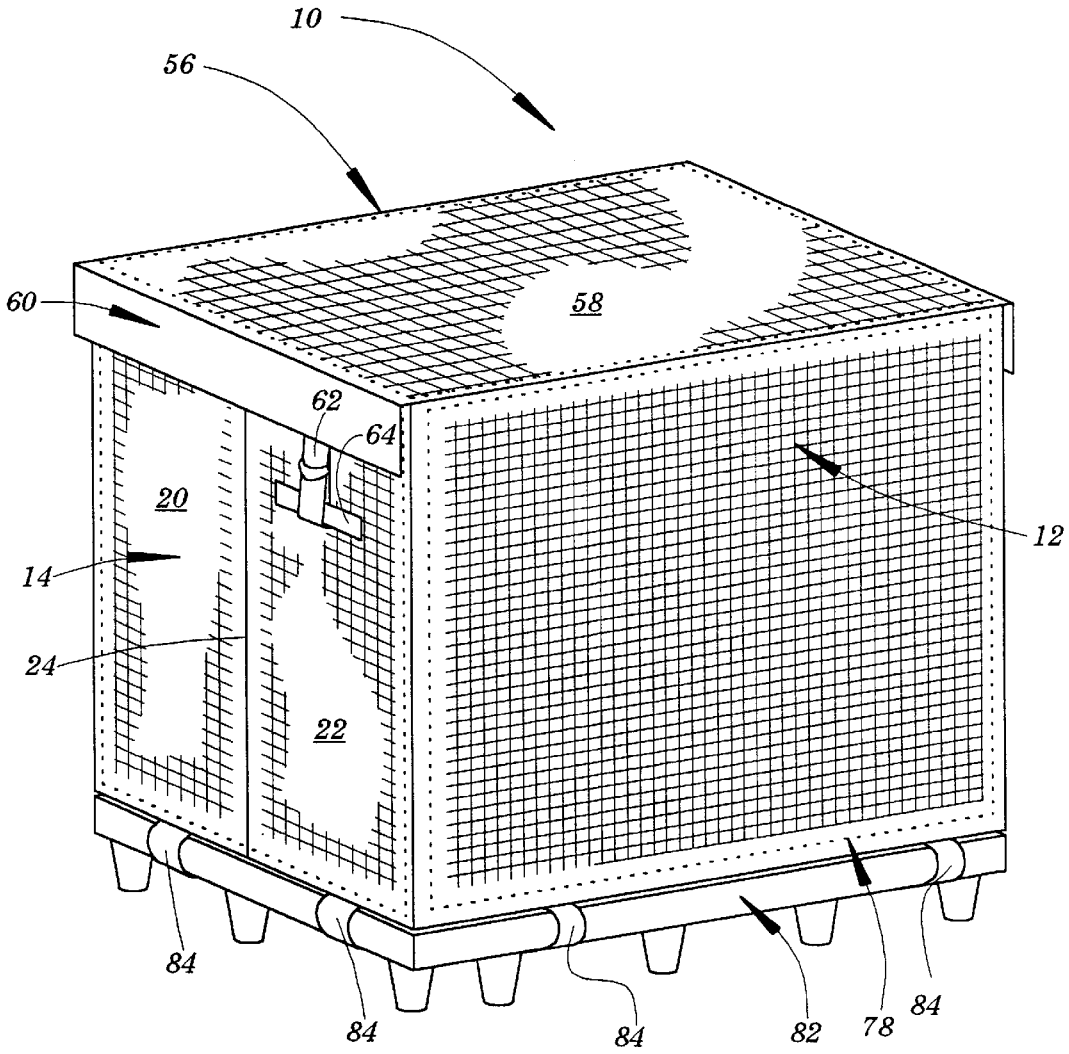
FIG. 4 is a rear perspective view of the container of FIG. 1 showing the consolidation container of the present invention with the top secured thereon.

Referring to FIG. 4, the consolidation container further includes a top 56. The top 56 includes a top panel 58 which overlies the interior of the consolidation container 10 as defined by the back wall 12, the side walls 14 and 16, and the front wall 18. The top 56 further includes a skirt 60 which extends downwardly from the top panel 58. The top 56 may be either fully removable or hingedly secured to the back wall 12. In either case the top 56 is fully openable.

Straps 62 are secured to the top 56 for engagement with loops 64 mounted on the back wall 12, the side walls 14 and 16, and the front wall 18 to secure the top 56 in place. Other types and kinds of fasteners can also be used to secure the top in place.

Figure 6:
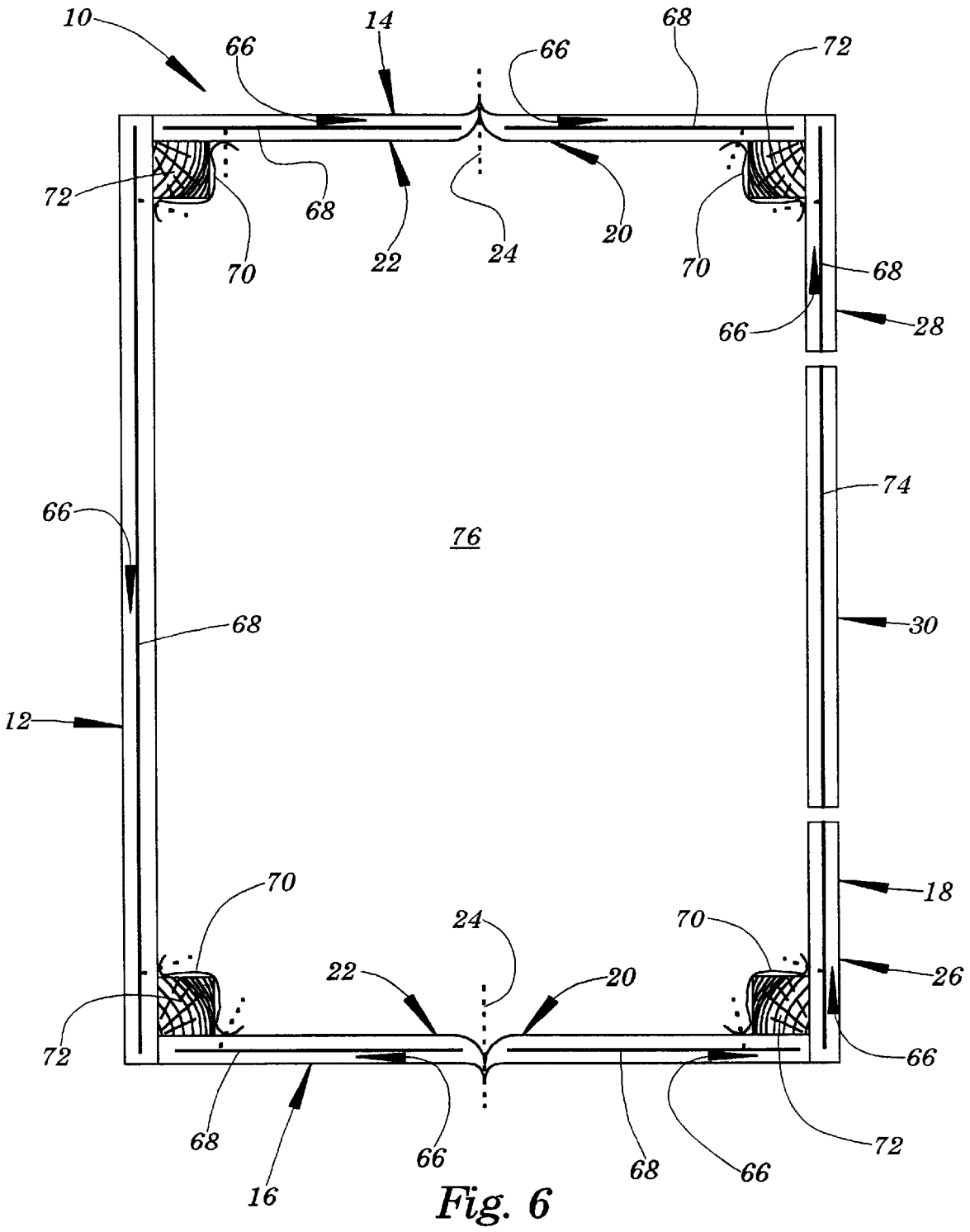
FIG. 6 is a horizontal sectional view of a consolidation container of FIG. 1.

As is best shown in FIG. 6, the back wall 12 of the consolidation container 10 comprises a double layer wall defining a stiffening panel receiving pocket 66. The side walls 14 and 16 each comprise double layer walls which define two stiffening panel receiving pockets 66 separated by the seams 24. The side portions 26 and 28 of the front wall 18 likewise comprise double layer walls defining stiffening panel receiving pockets 66. Each stiffening panel receiving pocket 66 receives a stiffening panel 68 therein. The stiffening panels 68 are substantially identical in length and width to the stiffening panel receiving pockets 66 in which they are received. As is best shown in FIG. 7, the top 56 may comprise a stiffening panel receiving pocket 66 which receives a stiffener panel 68, depending upon the particular application of the invention.

The stiffening panels 68 of the present invention may be manufactured from plastic panels of the type sold by Coroplast of Dallas, Tex., under the trademark COREX™. Other types of plastic panels may also be used, depending upon the requirements of particular applications of the invention. The stiffening panels 68 may also be formed from various types of paperboard; fiberboard, including medium density fiberboard (MDF); cardboard; plywood; and other materials depending upon the ability of stiffening panels formed from such materials to resist bending.

The corners between the back wall 12 and the side walls 14 and 16 and the corners between the front wall 18 and the side walls 14 and 16 have pockets 70 formed therein which extend the entire height of the consolidation container 10. The pockets 70 receive support members 72 therein. The support members 72 are preferably formed from wood, however, other materials may be used in the fabrication of the support members depending upon the requirements of particular applications of the invention.

Figure 7:
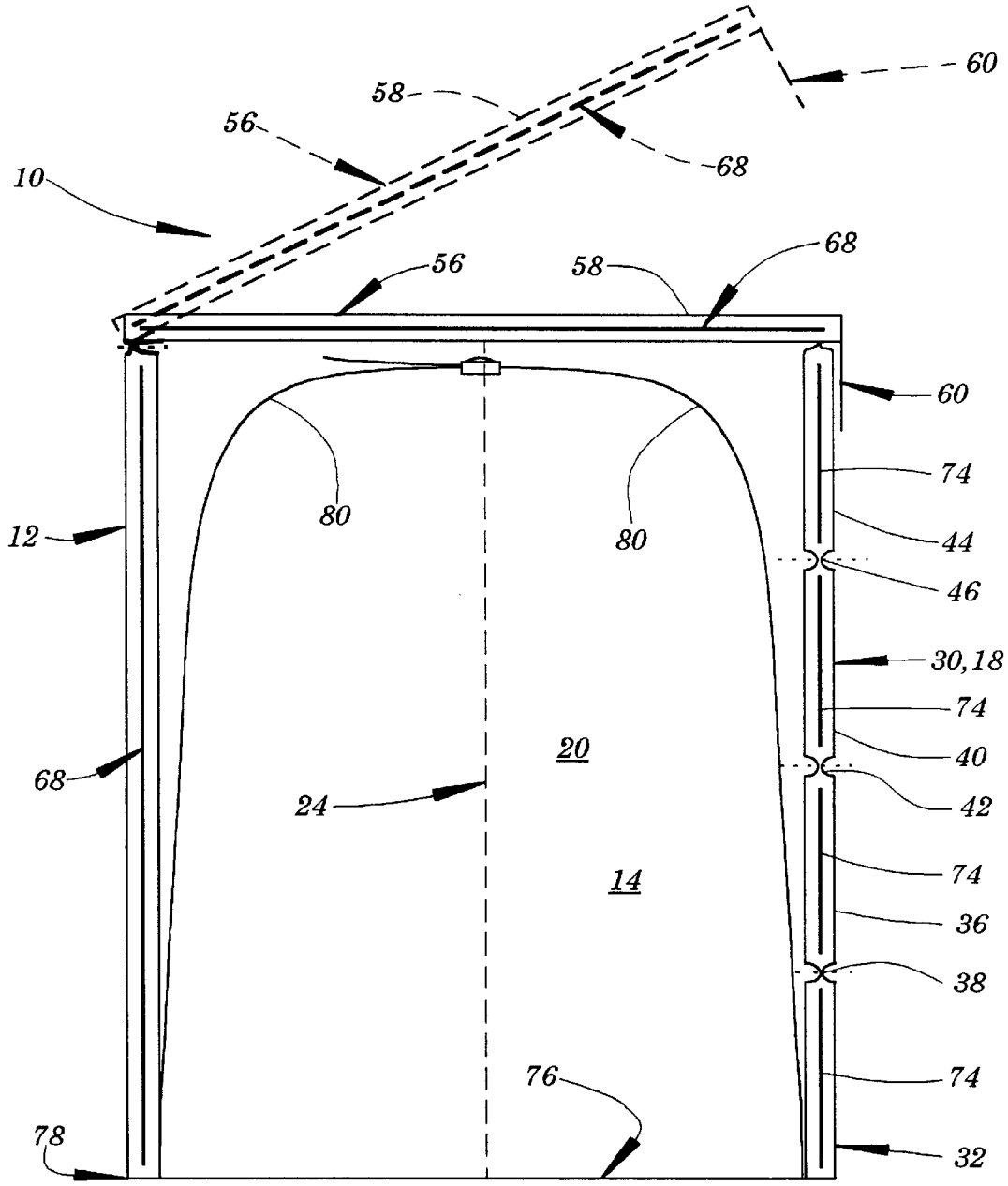
FIG. 7 is a vertical sectional view of the consolidation container of FIG. 1.

Referring to FIG. 7, the fixed section 32, the lower section 36, the center section 40, and the upper section 44 of the center portion 30 of the front wall 18 comprise double layer walls each having stiffening panels 74 received therein. The stiffening panels 74 extend substantially the entire length and width of the sections in which they are received. FIG. 7 further illustrates a bottom wall 76 of the consolidation container 10 which is secured to the lower edges of the back wall 12, the side walls 14 and 16, and the front wall 18 by a seam 78. Adjustable straps 80 extend upwardly from the bottom wall 76 for use in securing cargo within the interior of the consolidation container 10.

The back wall, the side walls, the front wall, the bottom wall, and the top may be formed from fabric. Preferably, woven polypropylene fabric is used to fabricate the consolidation container 10. When fabric is used, the several sections thereof are connected by stitching. Various plastic films can also be used to fabricate the consolidation container 10. When films are used, the several sections thereof are joined by heat sealing or by means of adhesives.

Figure 8:
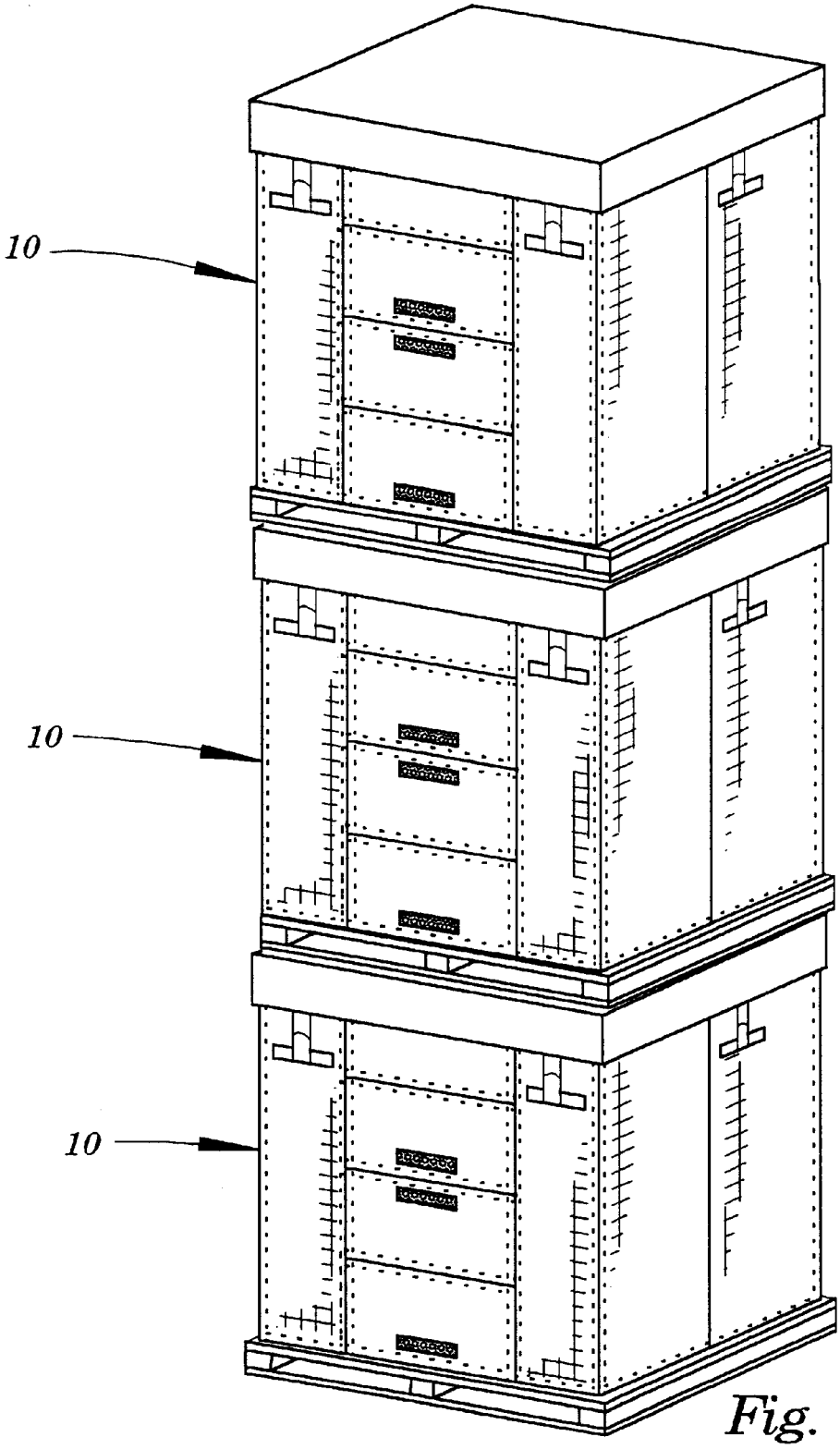
FIG. 8 is an illustration of containers comprising the invention stacked one upon another.

A primary advantage deriving from the use of the present invention is illustrated in FIG. 8. The stiffening panels 66 and 74 in the back wall 12, the side walls 14 and 16, and the front wall 18 together with the support members 72 located in the pocket 70 allow consolidation containers incorporating the invention to be stacked one upon another to a total height of up to six containers depending upon the density of the material received therein.

Figure 9:
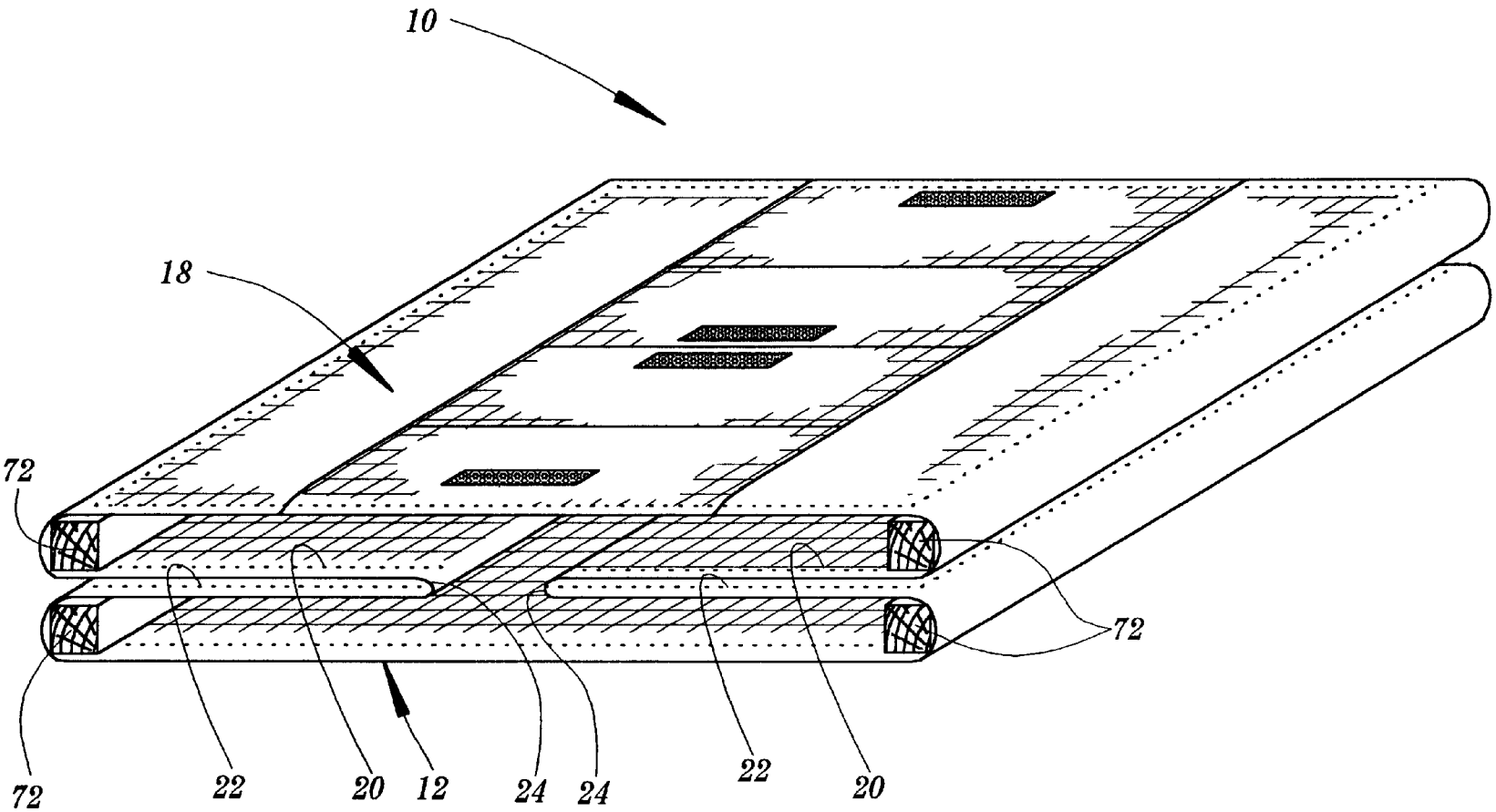
FIG. 9 is an illustration of the consolidation container of the present invention in its folded configuration.

Another advantage deriving from the use of the invention is illustrated in FIG. 9. The seams 24 of the side walls 14 and 16 allow the side walls to be folded inwardly. Inward folding of the side walls 14 and 16 in turn allows the consolidation container 10 to be fully collapsed in the manner illustrated in FIG. 9. In this manner, return shipment and/or storage of consolidation containers incorporated in the invention is facilitated.

Referring again to FIG. 1–4, inclusive, consolidation containers constructed in accordance with the invention are adapted for mounting on pallets 82. In such instances the consolidation container is preferably provided with releaseable straps 84 which are secured to the container 10 and which releaseably secure the container 10 to the pallet 82. As will be appreciated by those skilled in the art, the pallet 82 facilitates the transportation and positioning of the consolidation container 10.

Figure 5:
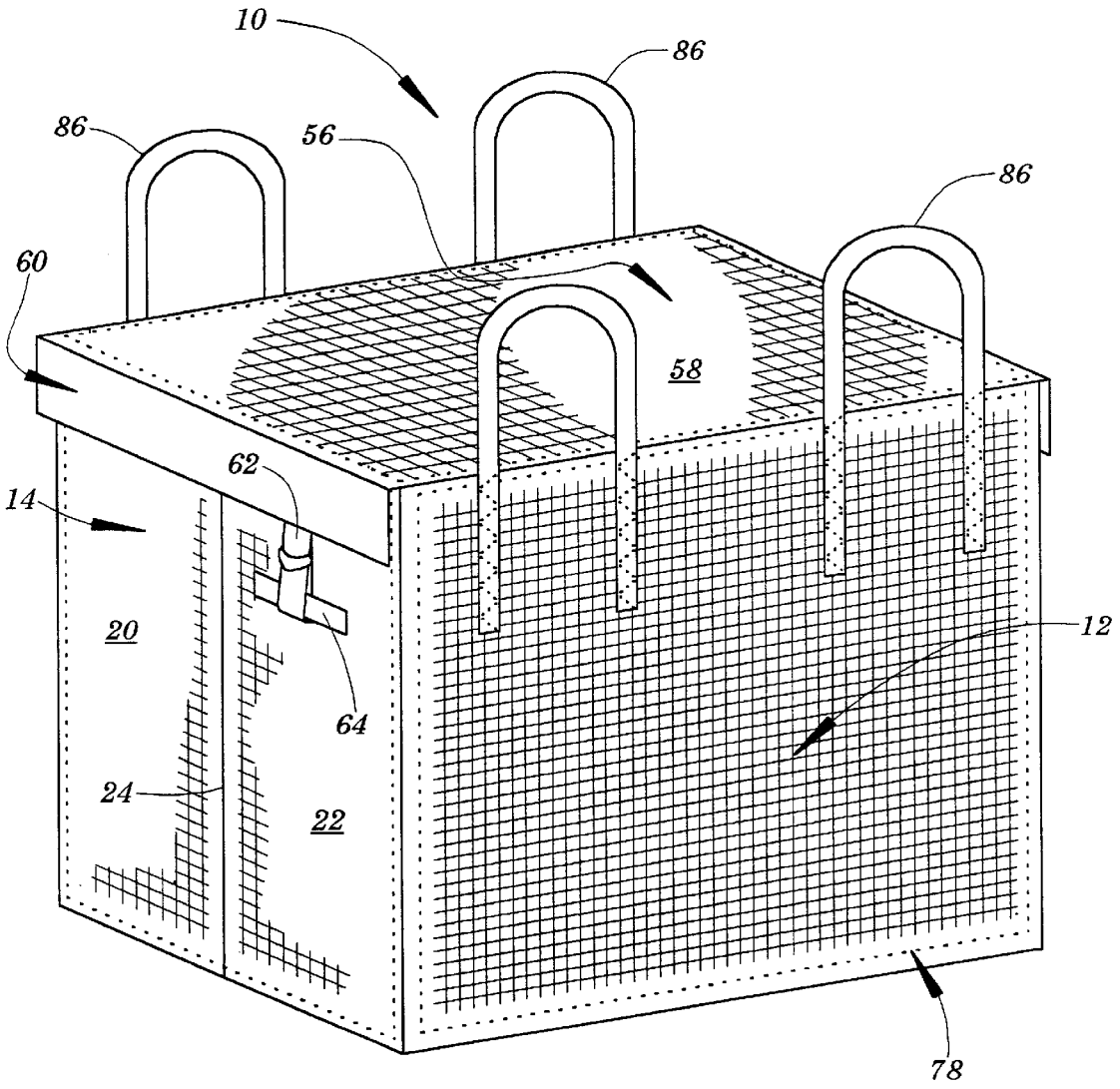
FIG. 5 is a view similar to FIG. 4 illustrating an alternative version of the consolidation container of FIG. 1.

Referring to FIG. 5, the consolidation container 10 of the present invention may be provided with lift loops 86. The lift loops 86 may be provided either in addition to or in lieu of the pallet 82. Like the pallet 82, the lift loops are utilized in the transportation and positioning of the consolidation container 10 and the contents thereof.

As will be understood by those skilled in the art, the consolidation container 10 of the present invention differs from prior consolidation container designs in that it employs a fully openable top and a front wall which is fully openable by pivoting the component parts thereof downwardly into the configuration illustrated in FIG. 2. By this means the interior of the consolidation container 10 is fully accessible to facilitate loading and unloading thereof. The consolidation container of the present invention is readily adapted for receiving, transporting, and storing newspapers and other printed materials, packaged food products, beverage containers, packaged automotive parts, home improvement parts, roofing shingles and similar materials, office supplies, and other unitized products.

In addition to providing unprecedented accessibility, the use of the consolidation container of the present invention is advantageous in that it is ready-to-use, both stackable and collapsible, and adapted both for reuse and/or recycling. It will therefore be understood that the use of the consolidation container of the present invention reduces both transportation and labor costs. Other advantages inherent in the use of the consolidation container of the present invention include reduced weight and resistance to damage from water and mildew.

Although preferred embodiments of the invention have been illustrated in the accompanying drawings and described in the foregoing Detailed Description, it will be understood that the invention is not limited to the embodiments disclosed, but is capable of numerous rearrangements, modifications, and substitutions of parts and elements without departing from the spirit of the invention.

What is claimed is:

1. A consolidation container comprising:

a double layer back wall comprising at least one stiffening panel receiving pocket;

a back wall stiffening panel received in the back wall stiffening panel receiving pocket;

opposed side walls each comprising at least one stiffening panel receiving pocket;

at least two side wall stiffening panels each received in one of the side wall stiffening panel receiving pockets;

a front wall comprising a plurality of stiffening panel receiving pockets;

a plurality of front wall stiffening panels each received in one of the front wall stiffening panel receiving pockets;

the front wall including an openable portion providing access to the interior of the consolidation container;

a plurality of support member receiving pockets located in the corners between the back wall and the side walls and in the corners between the side walls and the front wall;

a plurality of support members each positioned in one of the support member receiving pockets and each extending the entire height of the consolidation container;

a bottom wall extending between and connected to the lower edges of the back wall, the side walls, and the front wall; and a top normally extending between the upper edges of the back wall, the side walls, and the front wall and openable to provide access to the interior of the consolidation container.

2. The consolidation container according to claim 1 wherein each of the side walls comprises two stiffening panel receiving pockets separated by a centrally disposed vertically extending seam whereby the side walls are inwardly foldable, and further characterized by a plurality of side wall stiffening panels each received in one of the side wall stiffening panel receiving pockets.

3. The consolidation container according to claim 1 wherein said front wall is further comprised of two side portions each comprising a front wall stiffening panel receiving pocket and an openable center portion disposed between the side portions, and further characterized by a pair of front wall stiffening panels received in the stiffening panel receiving pockets comprising the side portions of the front wall.

4. The consolidation container according to claim 3 wherein the center portion of the front wall is further characterized by a fixed portion secured between the lower ends of the side portions of the front wall, and three foldable portions hingedly secured to the fixed portion and to one another and foldable between an extended position wherein the front wall is closed and a folded position overlying the fixed portion wherein the front wall is open.

5. The consolidation container according to claim 4 wherein each component of the center portion of the front wall comprises a double layer wall having a stiffening panel received therein.

6. The consolidation container according to claim 1 wherein each of the stiffening panel receiving pockets is characterized by predetermined width and height dimensions, and wherein each of the stiffening panels is characterized by predetermined width and height dimensions which are substantially matched to the width and height dimensions of the stiffening panel receiving pockets in which the stiffening panel is received.

7. The consolidation container according to claim 6 wherein the stiffening panels are formed from corrugated plastic.

8. The consolidation container according to claim 1 wherein the back, side, and front walls are substantially equal in height and wherein the height of the support members is substantially equal to the height of the walls.

9. The consolidation container according to claim 8 wherein the support members are formed from wood.

* * * * *